US008371680B2

(12) United States Patent
Komiyama et al.

(10) Patent No.: US 8,371,680 B2
(45) Date of Patent: Feb. 12, 2013

(54) SUBSTRATE HAVING PROTECTION LAYERS FOR LIQUID-EJECTION HEAD, LIQUID EJECTION HEAD, METHOD FOR MANUFACTURING SUBSTRATE FOR LIQUID-EJECTION HEAD, AND METHOD FOR MANUFACTURING LIQUID EJECTION HEAD

(75) Inventors: Hiroto Komiyama, Tokyo (JP); Yoshinori Tagawa, Yokohama (JP); Satoshi Ibe, Yokohama (JP); Mitsuru Chida, Yokohama (JP); Kazuhiro Asai, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 159 days.

(21) Appl. No.: 12/968,734

(22) Filed: Dec. 15, 2010

(65) Prior Publication Data

US 2011/0141197 A1 Jun. 16, 2011

(30) Foreign Application Priority Data

Dec. 16, 2009 (JP) ..... 2009-285782

(51) Int. Cl.
*B41J 2/05* (2006.01)

(52) U.S. Cl. ..... 347/64; 347/56; 347/65

(58) Field of Classification Search ..... 347/20, 347/45, 61–65, 67
See application file for complete search history.

(56) References Cited

U.S. PATENT DOCUMENTS

| | | | | | |
|---|---|---|---|---|---|
| 4,596,994 | A | * | 6/1986 | Matsuda et al. | 347/64 |
| 5,057,856 | A | * | 10/1991 | Takagi et al. | 347/64 |
| 5,187,499 | A | * | 2/1993 | Murakami | 347/64 |
| 5,703,630 | A | * | 12/1997 | Murakami et al. | 347/45 |
| 7,517,059 | B2 | | 4/2009 | Hayakawa | |

* cited by examiner

*Primary Examiner* — Juanita D Jackson
(74) *Attorney, Agent, or Firm* — Canon U.S.A., Inc., IP Division

(57) ABSTRACT

When an insulating layer is provided in order to protect an energy generating element, there arises a possibility that the layer dissolves in a contacting liquid. Therefore, in order to eject liquid, a first protection layer containing metal is provided on the insulating layer facing a substrate for a liquid-ejection head and a second protection layer containing metal is provided on the surface of a liquid supply port to which a base containing silicon is exposed.

15 Claims, 8 Drawing Sheets

SUBSTRATE HAVING PROTECTION LAYERS FOR LIQUID-EJECTION HEAD, LIQUID EJECTION HEAD, METHOD FOR MANUFACTURING SUBSTRATE FOR LIQUID-EJECTION HEAD, AND METHOD FOR MANUFACTURING LIQUID EJECTION HEAD

BACKGROUND OF THE INVENTION

1. Field of the Invention

The present invention relates to a substrate for a liquid-ejection head, a liquid ejection head, a method for manufacturing a substrate for a liquid-ejection head, and a method for manufacturing a liquid ejection head.

2. Description of the Related Art

As a recording device that performs recording operation by ejecting liquid, an ink jet printer that ejects ink is widely known. A liquid ejection head for use in such a recording device is provided with a substrate for a liquid-ejection head having an energy generating element that generates energy in order to eject liquid and a flow path member constituting a part of an ejection port or a liquid flow path. The substrate for a liquid-ejection head is provided with a supply port that supplies liquid to the energy generating element in such a manner as to penetrate a silicon base.

In recent years, in order to increase the color developability and durability of recorded images, the use of a strong alkaline liquid for ink has been examined. Since silicon dissolves in an alkaline solution, there is concern whether the silicon on the wall surface of the supply port dissolves in ink. In order to deal with the concern, U.S. Pat. No. 7,517,059 discloses a structure such that a protection layer is provided on the inner wall of the supply port so that the inner wall of the supply port does not dissolve in liquid.

In contrast, silicon compounds, such as silicon oxides and nitrides, are frequently used for an insulating layer that protects the energy generating element and is provided at the position facing the flow path, so that the energy generating element and line connected thereto are electrically insulated from ink.

However, as disclosed in U.S. Pat. No. 7,517,059, the protection performance of the insulating layer gradually decreases simply by forming a protection layer 15 at the inner side of the supply port, depending on the type and the use state of ink. Or, there is concern that ink leaks to line from a gap between the protection layer of the supply port and the insulating layer.

SUMMARY OF THE INVENTION

The present invention has been made in view of the above-described problems and provides a highly reliable substrate for a liquid ejection head in which the protection performance to an energy generating element is further increased.

The substrate for a liquid-ejection head of the present invention is provided with a first protection layer containing metal provided in such a manner as to cover an insulating layer and a second protection layer containing metal continuously provided from the first protection layer in such a manner as to cover the inner wall surface of a supply port.

The present invention has the protection layer containing metal on the surface of the insulating layer facing a flow path and the supply port, the energy generating element is more certainly protected and thus a highly reliable liquid ejection head can be provided.

Further features of the present invention will become apparent from the following description of exemplary embodiments with reference to the attached drawings.

DESCRIPTION OF THE EMBODIMENTS

A liquid ejection head can be mounted on devices, such as a printer, a copying machine, a facsimile having a communication system, and a word processor having a printing unit and also industrial recording devices complexly combined with various treatment devices. The use of the liquid ejection head allows recording on various recording media, such as paper, thread, fiber, fabric, leather, metal, plastic, glass, wood, and ceramics.

The "recording" used in this description means not only giving images having meanings, such as characters or figures, to recording media but giving images having no meanings, such as a pattern, to recording media.

The "liquid" needs to be widely interpreted and refers to liquid to be supplied for formation of an image, a design, a pattern, and the like, processing of a recording medium, or treatment of ink or a recording medium. The treatment of ink or a recording medium refers to an increase in fixability of a coloring material in ink to be given to a recording medium due to solidification or insolubilization thereof, an increase in recording quality or color developability, an increase in image durability, and the like.

Figure 1A:
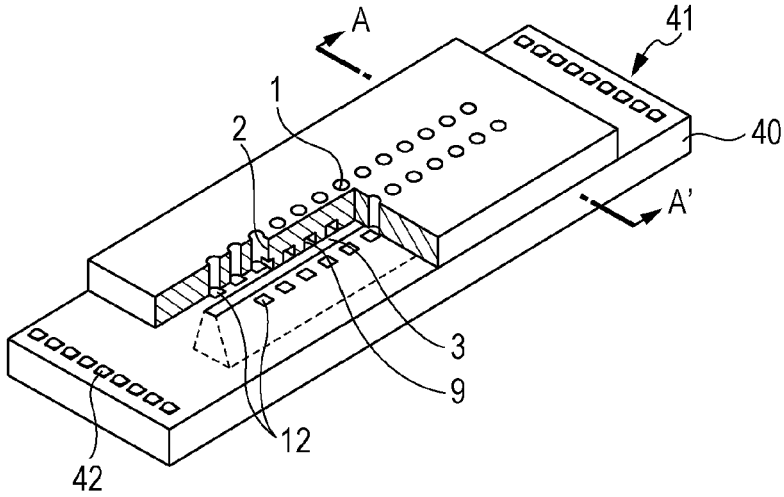
FIGS. 1A to 1C are a perspective view and cross sectional views of a liquid ejection head of the invention.
Figure 1B:
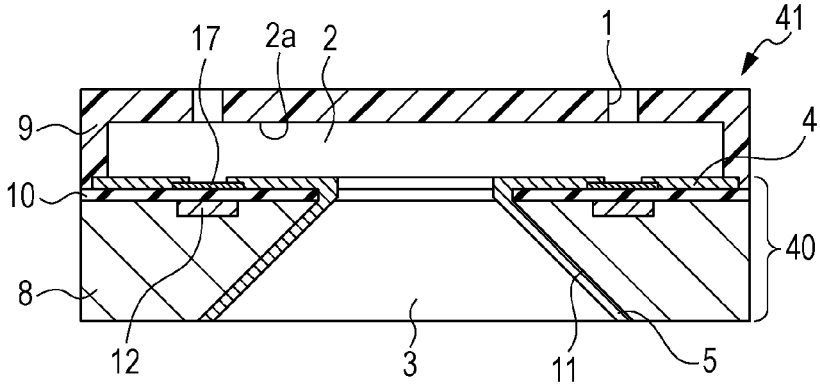

FIG. 1A is a perspective view of a liquid ejection head to which the invention can be applied. FIG. 1B is a cross sectional view along the A-A' line in FIG. 1A of a liquid ejection head according to a first embodiment. A liquid ejection head 41 of the first embodiment has a substrate for a liquid-ejection head 40 having energy generating elements 12 and a flow path member 9 provided on the substrate for a liquid-ejection head 40. The flow path member 9 has ejection ports 1 that eject liquid utilizing the energy generated by the energy generating elements 12 and a depression 2*a* of a flow path 2 communicating with the ejection ports 1. The flow path 2 is provided by making the flow path member 9 contact the substrate for a liquid-ejection head 40 so that the depression 2*a* is present on the inner side. Furthermore, the liquid ejection head 41 has a supply port 3 provided penetrating a base 8 containing silicon in order to deliver liquid to the flow path 2 and terminals 42 for electrical connection with the outside. Such a liquid ejection head is mounted on a support substrate of a liquid ejection unit (not illustrated) containing alumina or the like. The liquid supplied through the supply port 3 from the liquid ejection unit is delivered to the flow path 2, and is ejected from the ejection ports 1 by causing film boiling by the thermal energy generated by the energy generating elements 12, whereby recording operation is carried out.

The substrate for a liquid-ejection head 40 is provided with the energy generating elements 12 and an electric power line (not illustrated) to be connected to drive the energy generating elements 12. Furthermore, on the energy generating elements 12 and the electric power line, an insulating layer 10 containing silicon oxide and silicon nitride as the main ingredients is provided in order to secure insulation properties. The insulating layer 10 may be provided as a single layer or by stacking two or more layers. On a part of the insulating layer 10 located on the energy generating elements 12, a cavitation resistant layer 17 containing metal, such as Ta, is provided in order to protect the energy generating elements 12 from cavitation occurring when ejecting liquid.

On the insulating layer 10 and a part of the cavitation resistant layer 17, a first protection layer 4 containing metal is provided. Furthermore, on a surface 11 of the inner wall of the supply port 3, a second protection layer 5 containing metal is provided. Thus, the protection layers 4 and 5 containing metal provided on liquid contacting portions of the insulating layer 10 and the base 8 that contain silicon can prevent the dissolution of the insulating layer 10 or the base 8, even when, for example, a strong alkaline liquid that dissolves silicon is used. Specifically, it is confirmed that silicon dissolves when the liquid has a pH of 7 or more, i.e., alkaline. Particularly when the pH is 9 or more, i.e., strong alkaline, the silicon dissolution rate is high, and it can be said that it is difficult to use the liquid ejection head in a state where silicon is exposed as a liquid ejection head. Accordingly, by providing the protection layers 4 and 5, a highly reliable liquid ejection head can be achieved in which silicon is not dissolved even when such an alkaline liquid is used.

As metal materials for use in the first protection layer 4 and the second protection layer 5, metal materials, which are hard to dissolve in liquid such as ink, can be selected. Specifically, any one of Au, Ni, and Pt or an alloy thereof can be used. In the first protection layer 4 and the second protection layer 5, metal materials having the same composition can also be used. The cavitation resistant layer 17 is provided in such a manner as to cover a region larger than the region where the energy generating element 12 is provided and is provided so that the first protection layer 4 containing metal is not provided at the central portion of the cavitation resistant layer 17. Thus, by not providing the first protection layer 4 at the central portion of the cavitation resistant layer 17, the energy of the energy generating elements 12 can be efficiently delivered to liquid, and recording operation can be carried out. On the region where the first protection layer 4 is not provided, the cavitation resistant layer 17 containing metal, such as Ta, is provided, and thus liquid does not directly contact the insulating layer 10. Therefore, the insulating layer 10 does not dissolve. When the cavitation resistant layer 17 is not provided, the first protection layer 4 needs to be provided also on the region where the energy generating element 12 is provided. Since the support substrate is connected to the surface opposite to the surface of the silicon base provided with the energy generating elements 12, such a layer containing metal does not need to provide.

As described above, a highly reliable liquid ejection head can be provided by providing the first protection layer 4 on the liquid contacting portions on the insulating layer 10 and providing the second protection layer 5 on the supply port surface to which silicon is exposed.

FIGS. 2 and 3 are the cross sectional views along the A-A' line in FIG. 1A, which illustrate steps in a method for manufacturing a liquid ejection head.

Figure 2A:
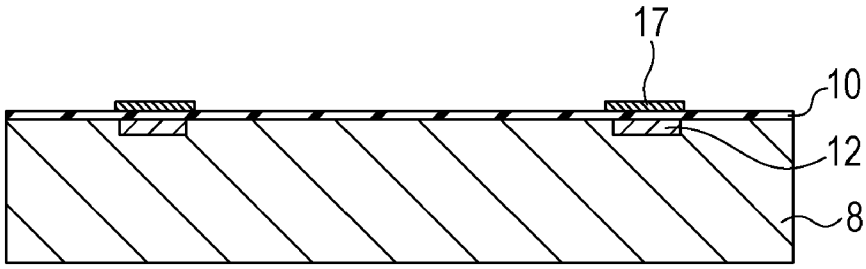
FIGS. 2A to 2F are cross sectional views illustrating steps in a method for manufacturing a liquid ejection head in a first embodiment.

First, as illustrated in FIG. 2A, the base 8 containing silicon provided with two or more of the energy generating elements 12 and an electric power line (not illustrated) electrically connected to the energy generating elements 12 is prepared. Furthermore, the insulating layer 10 is provided by stacking a layer containing silicon oxide (SiO) as the main ingredients and a layer containing silicon nitride (SiN) as the main ingredients on the energy generating elements 12 and the electric power line (not illustrated). The cavitation resistant layer 17 containing Ta as the main material is provided on the insulating layer 10 in such a manner as to be located above the energy generating element 12 and cover the same.

Figure 2B:
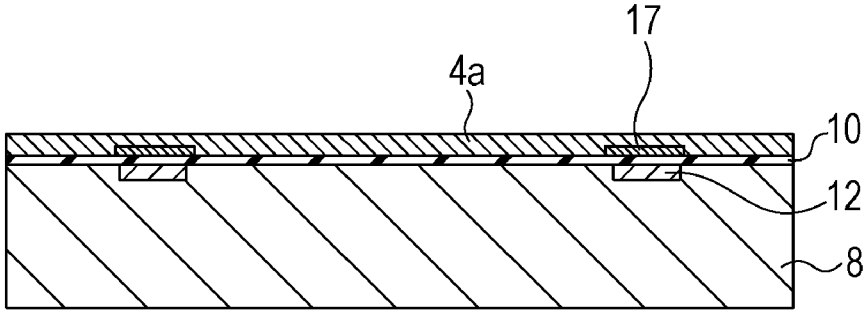

Next, as illustrated in FIG. 2B, a layer 4*a* containing metal is provided using a sputtering method on the insulating layer 10 on a first surface of the base 8 provided with the energy generating elements 12 and the cavitation resistant layers 17. Materials to be used as the layer 4*a* need to be materials that do not dissolve even when recording operation is carried out using a strong alkaline liquid or the like and any one of Au, Ni, and Pt or an alloy thereof can be used. Here, the case of using Au will be described.

Figure 2C:
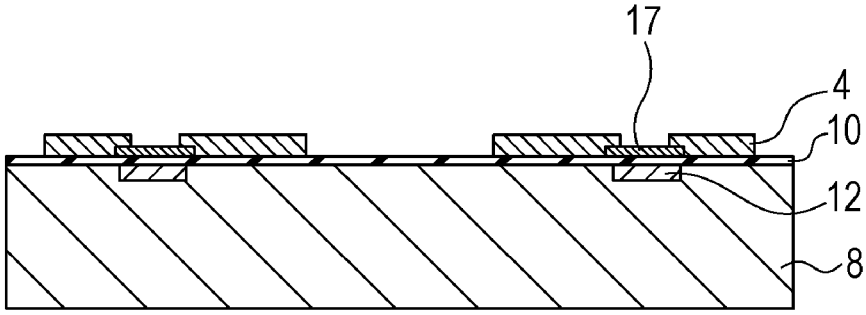

Next, on the layer 4*a*, a resist mask is provided using a photolithography method. Furthermore, the layer 4*a* positioned at the central portion of the cavitation resistant layer 17 is etched and removed using an iodine.potassium iodide solution capable of etching Au as illustrated in FIG. 2C and patterned into the first protection layer that protects the insulating layer 10 facing the flow path.

Figure 2D:
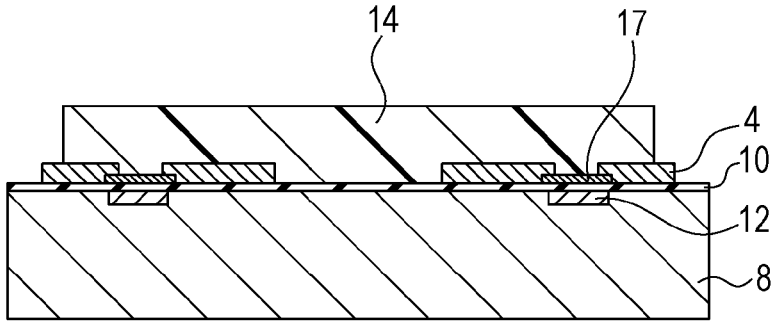

Next, a soluble photosensitive resin material is applied using a spin coat method or a roll coat method, and further a photolithography method is used, thereby forming a mold material 14 on the first protection layer 4 and the insulating layer 10 serving as the position at which the flow path 2 is provided (FIG. 2D). Any material may be used for materials of the mold material 14 insofar as the material hardly swells into a solvent contained in materials for use in a flow path member 9 to be provided on the mold material 14 and can easily dissolve later. Specifically, polymethyl isopropyl ketone having photosensitivity can be used.

Figure 2E:
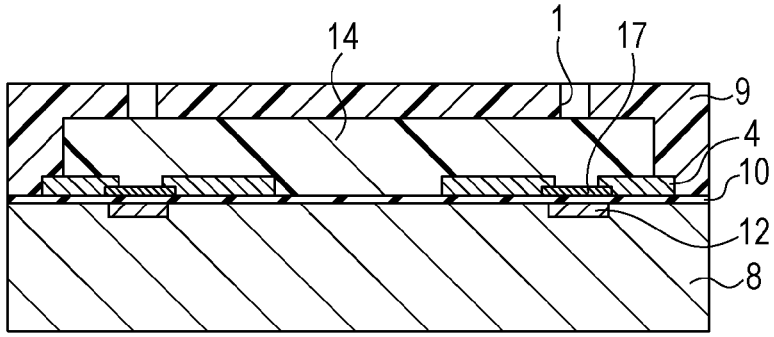

Next, a photosensitive resin material serving as the flow path member 9 is provided by a spin coat method or a roll coat method on the insulating layer 10 and the mold material 14, and is patterned using a photolithography method to form two or more ejection ports 1 (FIG. 2E). The photosensitive resin material needs to hardly swell due to liquid and have adhesion properties with the insulating layer 10, strength against external impact, and photosensitivity with which the ejection ports 1 can be provided with high precision. Specifically, a thermoplastic resin containing epoxy resin (EHPE-3150, DAICEL CHEMICAL INDUSTRIES, LTD.), polyether amide resin, polyimide resin, polycarbonate resin, polyester resin, or the like can be used. Next, a photosensitive resist is applied using a spin coat method or a roll coat method to a second surface of the base 8 opposite to the first surface provided with the energy generating elements 12, and a resist mask is provided using a photolithography method on portions other than the region where the supply port 3 is provided.

Figure 2F:
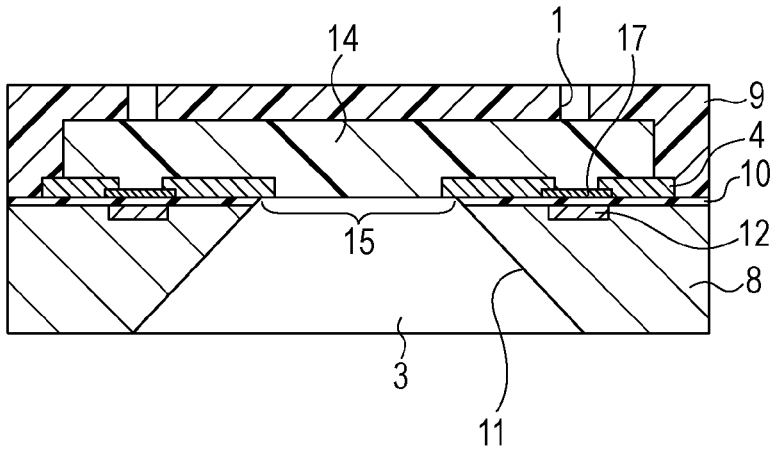

Furthermore, the base provided as illustrated in FIG. 2E is immersed in a TMAH (tetramethyl ammonium hydride) solution, and the supply port 3 penetrating the first surface and the second surface is provided using a wet etching method (FIG. 2F). The use of a silicon base in which the second surface is a (110) plane as the base 8 can provide the supply port 3 having an opening angle of about 54.7°.

Next, the insulating layer 10 of the opening 15 of the supply port 3 is removed. When silicon oxide and silicon nitride are used as the insulating layer 10, the silicon oxide is removed by a wet etching method using a buffered hydrofluoric acid and the silicon nitride is removed by a dry etching method using CF4 gas and O2 gas.

Figure 3A:
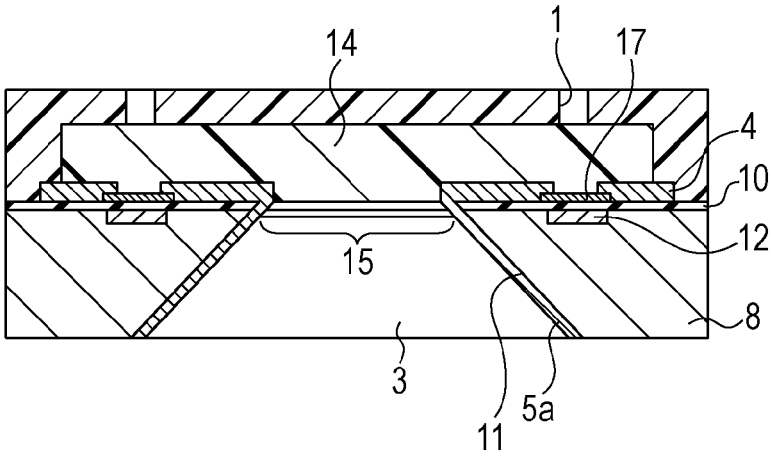
FIGS. 3A to 3C are cross sectional views illustrating steps in the method for manufacturing a liquid ejection head in the first embodiment.

Next, as illustrated in FIG. 3A, a layer 5*a* containing metal serving as the second protection layer 5 is provided on the surface 11 of the inner wall of the supply port 3 using a sputtering method. Even when recording operation is carried out using a strong alkaline liquid or the like similarly as in the first protection layer 4, the second protection layer 5 needs to contain a material that does not dissolve and any one of Au, Ni, and Pt or an alloy thereof can be used. Metal different from that of the first protection layer 4 can also be used.

Figure 3B:
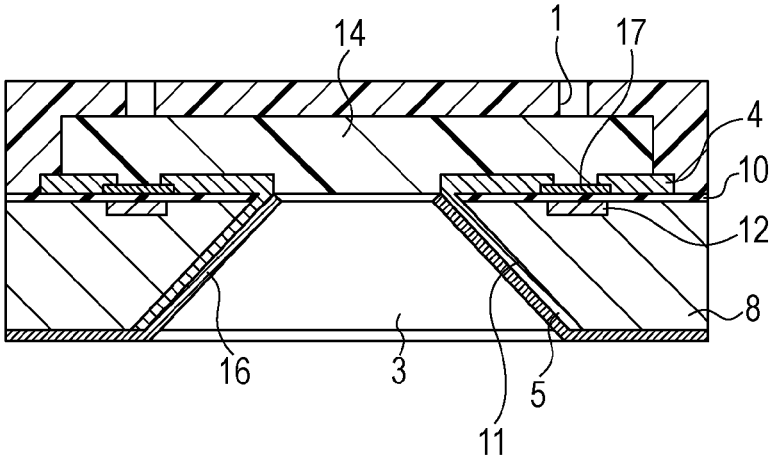

Next, a photosensitive resist is applied to the second surface of the base 8 using a spin coat method or a roll coat method, and then patterned using a photolithography method to provide a mask 16 on portions other than the opening 15. Subsequently, a part of the second protection layer 5*a* located at the opening 15 is removed by wet etching, thereby providing the second protection layer 5 (FIG. 3B).

Figure 3C:
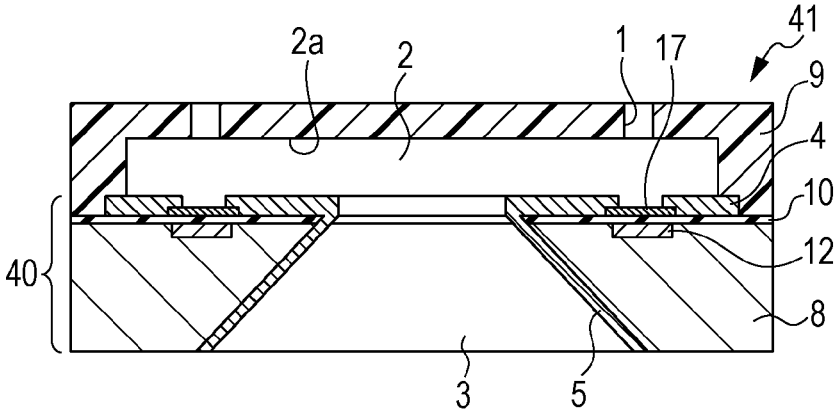

Next, the resist of the mask 16 is removed using a separation liquid or the like. The mold material 14 is exposed to UV light through the flow path member 9, and then immersed in methyl lactate to be removed, thereby communicating the supply port 3, the flow path 2, and the ejection ports 1 (FIG. 3C).

By the above-described manufacturing method, a liquid ejection head 41 is completed in which the first protection layer 4 and the second protection layer 5 are provided so that liquid does not directly contact the top of the silicon containing portion. Thus, the insulating layer 10 or the surface 11 of the inner wall of the supply port 3 containing silicon can be prevented from dissolving in liquid, whereby a highly reliable liquid ejection head can be provided.

Figure 1C:
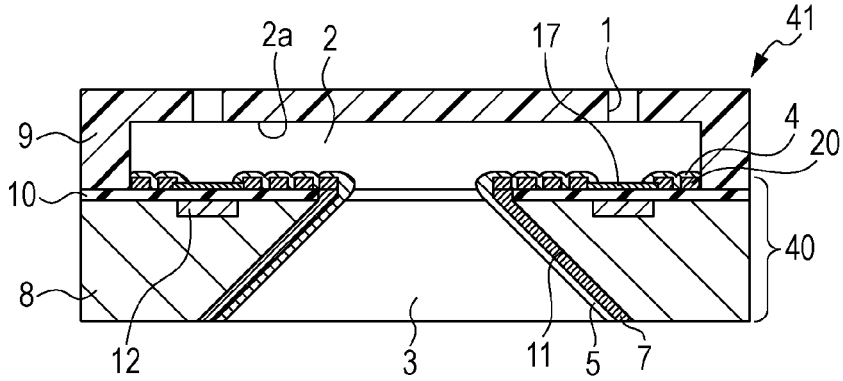

FIG. 1C is a cross sectional view along the A-A' line in FIG. 1A of a liquid ejection head 41 according to a second embodiment. The surface of the flow path 2 of the first protection layer 4 of the liquid ejection head 41 has irregularities, which are provided so as to give hydrophilicity to liquid. In this case, the center line average roughness Ra of the surface of the first protection layer 4 is controlled to be 0.02 μm<Ra≦0.3 μm. This is because when the Ra is 0.02 or lower, the surface is hydrophobic to liquid and when Ra becomes larger than 0.3 μm, the irregularities in the flow path are excessively large, which makes it impossible to quickly refill liquid after ejection, resulting in the fact that continuous ejection cannot be carried out. Thus, by providing the first protection layer 4 having irregularities to render the surface hydrophilic, even when bubbles generate around the ejection ports 1, the bubbles can be discharged to the outside of the flow path 2, and thus poor ejection or the like due to the bubbles can be prevented.

The other structures are the same as those of the first embodiment. Hereinafter, a manufacturing method of the second embodiment will be described.

FIGS. 4 and 5 each are the cross sectional views along the A-A' line in FIG. 1A, which illustrate steps in a method for manufacturing the liquid ejection head.

Figure 4A:
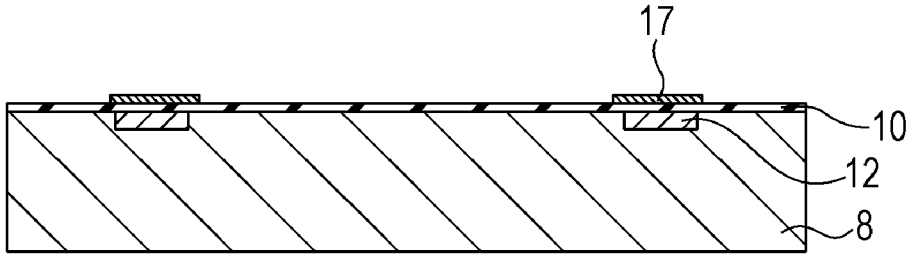
FIGS. 4A to 4F are cross sectional views illustrating steps in a method for manufacturing a liquid ejection head in a second embodiment.

First, as illustrated in FIG. 4A, the base 8 containing silicon provided with two or more of the energy generating elements 12 and an electric power line (not illustrated) electrically connected to the energy generating elements 12 is prepared. Furthermore, the insulating layer 10 is provided by stacking a layer containing silicon oxide (SiO) as the main ingredients and a layer containing silicon nitride (SiN) as the main ingredients on the energy generating elements 12 and the electric power line (not illustrated). The cavitation resistant layer 17 containing Ta as the main material is provided on the insulating layer 10 in such a manner as to be located above the energy generating element 12 and cover the same.

Figure 4B:
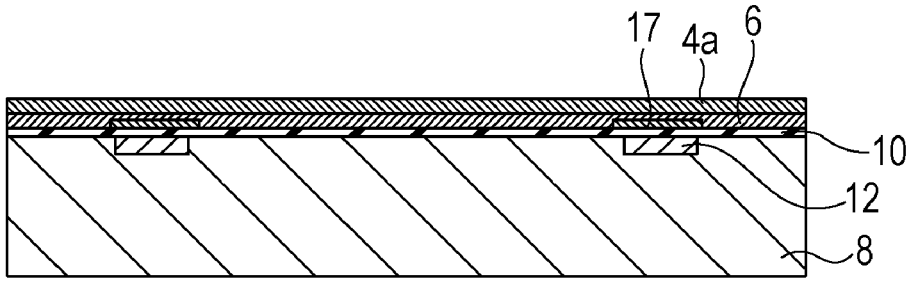

Next, as illustrated in FIG. 4B, layers that will be petterned to form concavo-convex members 20 are provided. The concavo-convex members 20 serve as the core of the first protection layer 4 on the insulating layer 10 on a first surface of the base 8 provided with the energy generating elements 12 and the cavitation resistant layers 17. The concavo-convex member 20 can be obtained by stacking a first intermediate layer 6 containing titanium tungsten (TiW) and a layer 4*a* containing metal using a sputtering method. Materials for use in the layer 4*a* containing metal need to be materials that do not dissolve even when recording operation is carried out using a strong alkaline liquid or the like and to serve as the core when an electroless plating method is performed and any one of Au, Ni, and Pt or an alloy thereof can be used. Here, the case of using Au will be described. The first intermediate layer 6 is used as a migration preventing layer that prevents migration of the materials for use in the first protection layer 4 or the layer 4*a* containing metal in the insulating layer 10. The first intermediate layer 6 may have a stacked structure containing two or more layers and the intermediate layer may be not provided when the migration is not observed.

Figure 4C:
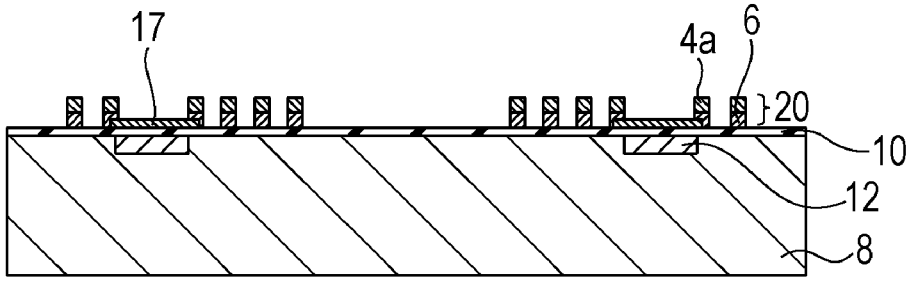

Next, on the layer 4*a*, a resist mask is provided using a photolithography method and then patterned as illustrated in FIG. 4C using an iodine.potassium iodide solution capable of etching Au of the layer 4*a*. Further, the first intermediate layer 6 containing titanium tungsten is patterned using hydrogen peroxide water. Thus, the concavo-convex members 20 are provided.

Figure 6A:
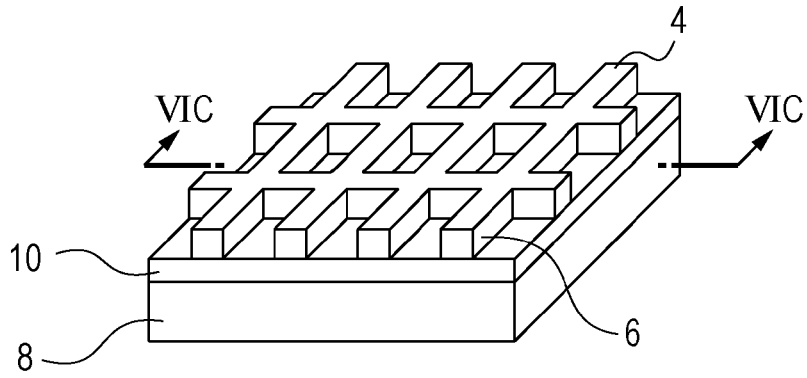
FIGS. 6A to 6C are enlarged views of a part of the liquid ejection head in the second embodiment.
Figure 6B:
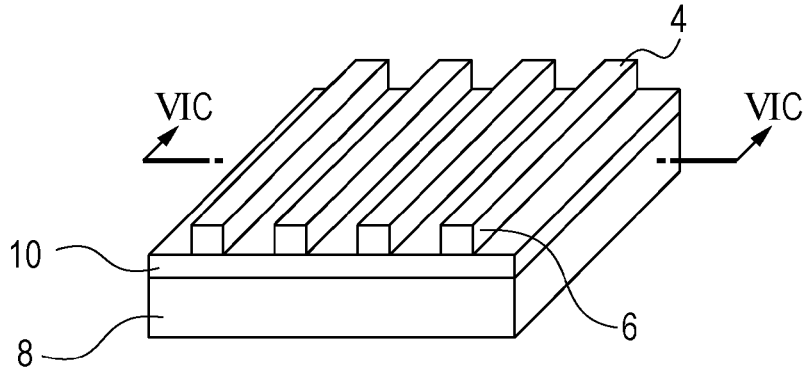
Figure 6C:
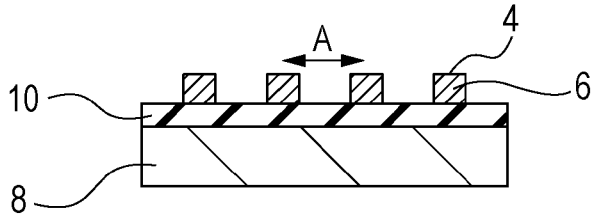

The concavo-convex members 20 can be provided in the shape of a lattice as illustrated in FIG. 6A or in a row as illustrated in FIG. 6B. The cross sectional view along the VIC-VIC line in FIGS. 6A and 6B is illustrated in FIG. 6C. The concavo-convex member 20 is preferably provided so that the width is 0.1 μm≦A≦4 μm. By adjusting the width to 0.1 μm≦A, metal can be effectively deposited when an electroless plating method is performed. By adjusting the width to A≦4 μm, the film thickness of the layer 4 is 2 μm or lower even when the layer 4 is deposited without exposing the insulating layer 10, and the energy generated by the energy generating elements 12 can be efficiently delivered to liquid.

Figure 4D:
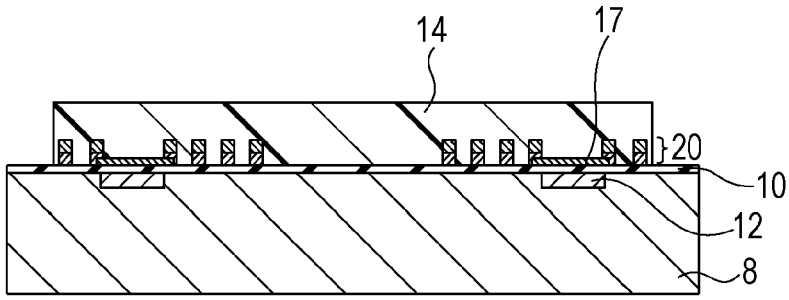

Next, a soluble photosensitive resin material is applied using a spin coat method or a roll coat method, and further a photolithography method is used, thereby forming a mold material 14 on the first protection layer 4 and the insulating layer 10 serving as the position at which the flow path 2 is provided (FIG. 4D). Any material may be used for materials of the mold material 14 insofar as the material hardly swells into a solvent contained in materials for use in a flow path member 9 to be provided on the mold material 14 and can easily dissolve later. Specifically, polymethyl isopropyl ketone having photosensitivity can be used.

Figure 4E:
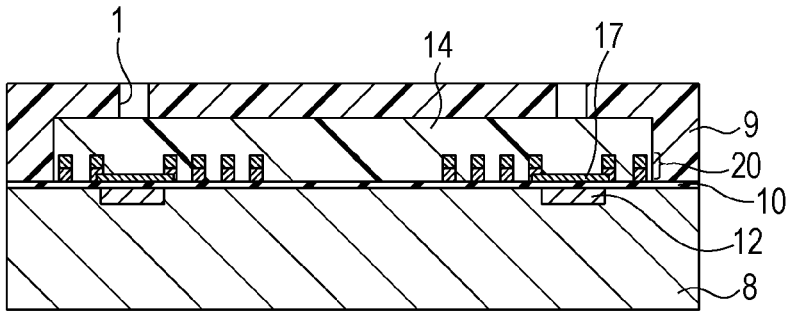

Next, a photosensitive resin material serving as the flow path member 9 is provided by a spin coat method or a roll coat method on the insulating layer 10 and the mold material 14, and is patterned using a photolithography method to form two or more ejection ports 1 (FIG. 4E). The photosensitive resin material needs to hardly swell due to liquid and have adhesion properties with the insulating layer 10, strength against external impact, and photosensitivity with which the ejection ports 1 can be provided with high precision. Specifically, a thermoplastic resin containing epoxy resin (EHPE-3150, DAICEL CHEMICAL INDUSTRIES, LTD.), polyether amide resin, polyimide resin, polycarbonate resin, polyester resin, or the like can be used. Next, a photosensitive resist is applied using a spin coat method or a roll coat method to a second surface of the base 8 opposite to the first surface provided with the energy generating elements 12, and a resist mask is provided using a photolithography method on portions other than the region where the supply port 3 is provided.

Figure 4F:
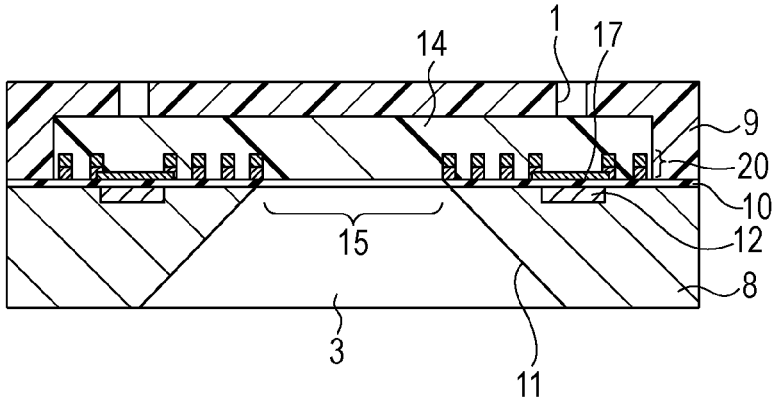

Furthermore, the base provided as illustrated in FIG. 4E is immersed in a TMAH (tetramethyl ammonium hydride) solution, and the supply port 3 penetrating the first surface and the second surface is provided using a wet etching method (FIG. 4F). The use of a silicon base in which the second surface is a (110) plane as the base 8 can provide the supply port 3 having an opening angle of about 54.7°.

Next, the insulating layer 10 of the opening 15 of the supply port 3 is removed. When silicon oxide and silicon nitride are used as the insulating layer 10, the silicon oxide is removed by a wet etching method using a buffered hydrofluoric acid and the silicon nitride is removed by a dry etching method using CF4 gas and O2 gas.

Figure 5A:
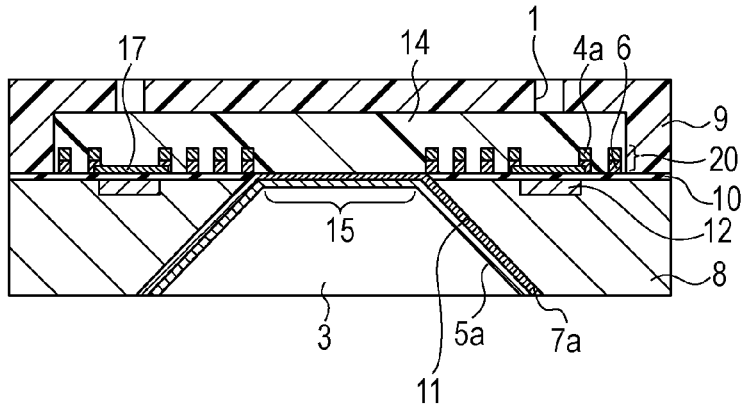
FIGS. 5A to 5D are cross sectional views illustrating steps in the method for manufacturing a liquid ejection head in the second embodiment.

Next, as illustrated in FIG. 5A, a layer 7*a* serving as a portion of the second intermediate layer 7 containing titanium tungsten and a layer 5*a* containing metal serving as a part of the second protection layer 5 that can be used as the core when an electroless plating method is performed are provided by a sputtering method on the surface 11 of the inner wall of the supply port 3. The layer 5*a* containing metal need to contain materials that do not dissolve even when recording operation is carried out using a strong alkaline liquid or the like and to serve as the core when an electroless plating method is performed and any one of Au, Ni, and Pt or an alloy thereof can be used. The second intermediate layer 6 is used as a migration preventing layer that prevents migration of the materials for use in the second protection layer 5 in the insulating layer 10. The second intermediate layer 7 also may have a stacked structure containing two or more layers and the intermediate layer may be not provided when the migration is not observed.

Figure 5B:
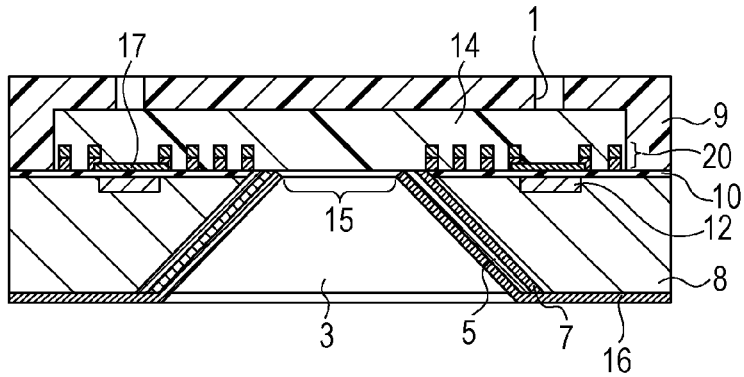

Next, a photosensitive resist is applied to the second surface side of the base 8 using a spin coat method or a roll coat method and further patterned using a photolithography method, thereby providing a mask 16 on portions other than the opening 15. Subsequently, the layer 5*a* and the layer 7*a* located in the opening 15 are partially removed by wet etching, thereby providing the second protection layer 5 and the second intermediate layer 7 (FIG. 5B).

Figure 5C:
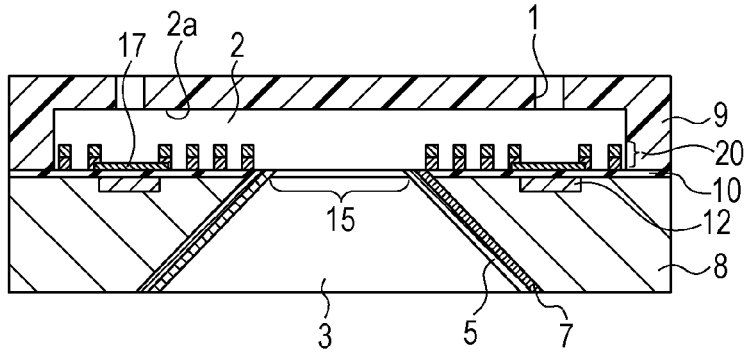

Next, the resist of the mask 16 is removed using a separation liquid or the like. The mold material 14 is exposed to UV light through the flow path member 9, and then immersed in methyl lactate to be removed, thereby communicating the supply port 3, the flow path 2, and the ejection ports 1 (FIG. 5C).

Figure 5D:
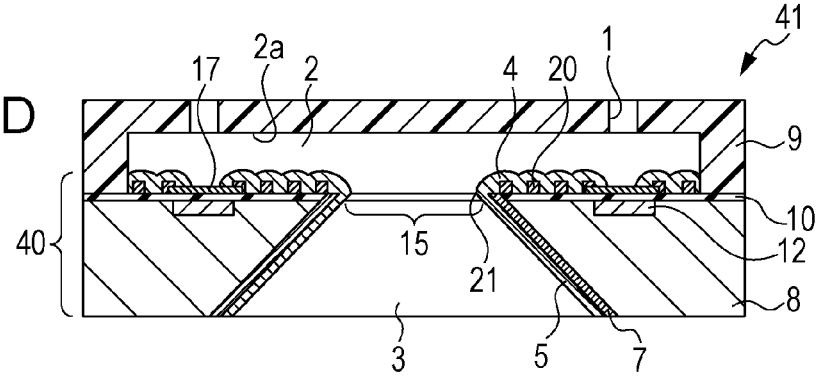

Next, as illustrated in FIG. 5D, by using the layers 4*a* of the concavo-convex members 20 as the core of electroless plating, the first protection layer 4 is deposited. Usable for the plating layer are materials containing Au, Ni, or Pt that does not dissolve even when recording operation is performed using a strong alkaline liquid or the like. By performing electroless plating using the second protection layer 5 as the core, the film thickness of the second protection layer 5 can be increased, and a more highly reliable second protection layer 5 can be achieved.

When the first protection layer 4 and the second protection layer 5 contain the same material, the layers can be simultaneously deposited. When a different metal is used for the first protection layer 4 and the second protection layer 5, electroless plating deposition may be performed two or more times.

The electroless plating method is performed until the surface of the insulating layer 10 of the substrate for a liquid-ejection head 40 is covered with the first protection layer 4. The film thickness of the first protection layer 4 and the film thickness of the second protection layer 5 vary depending on the width A of the concavo-convex members 20. When the concavo-convex members 20 are provided with a width A of 0.2 μm, the electroless plating deposition height needs to be 0.1 μm or more. More specifically, when the width between the adjacent concavo-convex members 20 is defined as A and the film thickness of the Au of the first protection layer 4 is defined as B, $A/2 \leqq B$ needs to be established. The thickness of the first protection layer 4 by an electroless plating method is preferably set to 2 μm or lower so that the energy generated by the energy generating elements 12 can be efficiently delivered to liquid.

With respect to the surface roughness of the first protection layer 4, the center line average roughness Ra is preferably adjusted to $0.02\ \mu m < Ra \leqq 0.3\ \mu m$. Thus, the hydrophilicity can be increased on the ink contact surface of the flow path 2 and the influence caused by bubbles can be reduced.

By the above-described manufacturing method, a highly reliable liquid ejection head can be provided in which the insulating layer 10 or the surface 11 of the inner wall of the supply port 3 containing silicon can be prevented from dissolving in liquid and the influence caused by bubbles.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-285782 filed Dec. 16, 2009, which is hereby incorporated by reference herein in its entirety.

What is claimed is:

1. A substrate for liquid-ejection heads comprising:

a base containing silicon;

an element provided on the base to generate energy to be utilized for ejecting liquid;

an insulating layer provided as to cover the element;

a liquid supply port provided penetrating the base;

a first protection layer containing metal provided in such a manner as to cover the insulating layer; and a second protection layer containing metal continuously connected to the first protection layer as to cover the surface of the inner wall of the supply port.

2. The substrate for a liquid-ejection head according to claim 1, wherein the insulating layer contains at least one of silicon nitride and silicon oxide.

3. The substrate for a liquid-ejection head according to claim 1, wherein materials for use in the first protection layer and the second protection layer include any one of Au, Ni, and Pt.

4. The substrate for a liquid-ejection head according to claim 3, wherein the composition of the first protection layer and the composition of the second protection layer are the same.

5. The substrate for a liquid-ejection head according to claim 1, further comprising:

a cavitation resistant layer that is provided so as to be positioned on the insulating layer and above the element; wherein the first protection layer is not provided on the cavitation resistant layer.

6. The substrate for a liquid-ejection head according to claim 1, wherein the first protection layer is hydrophilic.

7. The substrate for a liquid-ejection head according to claim 1, wherein the first protection layer is provided so that a center line average roughness (Ra) is 0.02 μm<Ra≦0.3 μm.

8. A liquid ejection head, comprising:

the substrate for a liquid-ejection head according to claim 1; and a flow path member having a depression serving as a flow path communicating with an ejection port and forming the flow path by contacting the substrate for a liquid-ejection head so that the depression is on the inner side.

9. The substrate for a liquid-ejection head according to claim 1, wherein the first protection layer is directed connected to the second protection layer.

10. A method for manufacturing a substrate for a liquid-ejection head having an element that generates energy for ejecting liquid from an ejection port, the method comprising:

preparing a base containing silicon having a surface provided with the element and an insulating layer provided as to cover the element;

providing a first protection layer containing metal as to cover the insulating layer;

providing a supply port penetrating the surface of the base and another surface opposite to the surface; and providing a second protection layer containing metal and being continuous from the first protection layer as to cover the surface of the inner wall of the supply port.

11. The method for manufacturing a substrate for a liquid-ejection head according to claim 10, wherein the first protection layer is provided by:

providing a member containing metal on a part of the insulating layer; and providing the first protection layer using an electroless plating method using the member as the core.

12. The method for manufacturing a substrate for a liquid-ejection head according to claim 10, wherein materials for use in the first protection layer and the second protection layer include any one of Au, Ni, and Pt.

13. The method for manufacturing a substrate for a liquid-ejection head according to claim 10, wherein the surface on the flow path side of the first protection layer is hydrophilic.

14. The method for manufacturing a substrate for a liquid-ejection head according to claim 10, wherein the surface on the flow path side of the first protection layer is provided so that a center line average roughness (Ra) is 0.02 μm<Ra≦0.3 μm.

15. A method for manufacturing a liquid ejection head, the method comprising:

preparing the substrate for a liquid-ejection head according to claim 10; and providing a flow path member having a depression of a flow path and containing resin forming the flow path by contacting the surface of the substrate for a liquid-ejection head so that the depression is on the inner side.

* * * * *